US009254560B2

(12) United States Patent
Rubin et al.

(10) Patent No.: US 9,254,560 B2
(45) Date of Patent: Feb. 9, 2016

(54) AUTO EMERGENCY TOOL

(71) Applicant: InterDesign, Inc., Solon, OH (US)

(72) Inventors: Bennett S. Rubin, Pepper Pike, OH (US); Richard C. Adamany, Chagrin Falls, OH (US)

(73) Assignee: InterDesign, Inc., Solon, OH (US)

( * ) Notice: Subject to any disclaimer, the term of this patent is extended or adjusted under 35 U.S.C. 154(b) by 218 days.

(21) Appl. No.: 14/212,979

(22) Filed: Mar. 14, 2014

(65) Prior Publication Data

US 2014/0259438 A1 Sep. 18, 2014

Related U.S. Application Data

(60) Provisional application No. 61/787,203, filed on Mar. 15, 2013.

(51) Int. Cl.

| | |
|---|---|
| ***B26B 11/00*** | (2006.01) |
| ***B25F 1/00*** | (2006.01) |
| ***A62B 3/00*** | (2006.01) |

(52) U.S. Cl.

CPC ..... *B25F 1/006* (2013.01); *A62B 3/005* (2013.01); *Y10T 29/4998* (2015.01); *Y10T 225/371* (2015.04)

(58) Field of Classification Search

CPC A62B 3/005; Y10T 225/371; Y10T 29/4998; B25F 1/006

USPC ..... 7/158, 163, 164; 81/20

See application file for complete search history.

(56) References Cited

U.S. PATENT DOCUMENTS

| | | | | | |
|---|---|---|---|---|---|
| 4,103,378 | A * | 8/1978 | Granados | B25B 27/22 | 29/407.01 |
| 4,209,870 | A | 7/1980 | Doyel | | |
| 4,290,095 | A | 9/1981 | Schmidt | | |
| 4,363,147 | A * | 12/1982 | Deweese | B25F 1/00 | 7/158 |
| 4,528,751 | A * | 7/1985 | Olson | A22C 21/063 | 294/55.5 |
| 5,642,567 | A * | 7/1997 | Lin | A62B 3/005 | 30/366 |
| 5,657,543 | A | 8/1997 | Collins | | |

(Continued)

*Primary Examiner* — Hadi Shakeri
*Assistant Examiner* — Danny Hong
(74) *Attorney, Agent, or Firm* — Calfee, Halter & Griswold LLP

(57) ABSTRACT

An ergonomic auto emergency tool for alternatively functioning as a flashlight, an illuminating distress signal, a sonic alarm, a tire depth gauge, a tire air pressure gauge, a seat belt cutter and a motor vehicle window glass breaker. The auto emergency tool includes a main portion and a projecting portion extending from a joining portion and being integral with the main portion, and defining a seat belt-receiving notch therebetween. A knife blade extends across the notch proximate the joining portion. An inner main portion-facing upper surface of the projecting portion is configured to facilitate the movement of the tool towards and through a seat belt, and the bottom outer surface of the projecting portion is curved for both easy handling and for enabling a firm grip when the tool is used to break window glass. The window-breaking mechanism includes a depressible plunger cover for releasing a spring-loaded impact member. A projecting portion and a main housing portion cooperate to define a seat belt receptacle. A blade cover is insertable into the seat belt receptacle. A blade cover includes a tire tread-depth gauge. The auto emergency tool further has a tire pressure gauge with a digital display. An optional visor clip is also provided for storing the tool on the visor of a motor vehicle. The visor clip has an alternate blade cover for attaching the tool to the visor.

9 Claims, 14 Drawing Sheets

(56) References Cited

U.S. PATENT DOCUMENTS 5,952,916 A 9/1999 Yamabe
6,142,769 A * 11/2000 Walker ..... F23Q 2/32 362/119
6,257,093 B1 * 7/2001 Bergacker ..... A62B 3/005 7/165
6,282,740 B1 * 9/2001 Sobotka ..... B25F 1/04 7/143
6,418,628 B1 7/2002 Steingss
6,574,816 B2 * 6/2003 Yu Chen ..... B25G 1/085 7/100
6,766,933 B1 * 7/2004 Wang ..... A62B 3/005 173/202
7,028,874 B2 * 4/2006 Lin ..... A62B 3/005 173/202
7,033,042 B2 4/2006 Lim
7,051,391 B2 * 5/2006 Wang ..... B25F 1/00 7/144
D575,182 S 8/2008 Rubin et al.
7,487,565 B1 * 2/2009 Sundling ..... A01M 31/00 294/153
D595,105 S * 6/2009 White ..... D8/105
7,557,720 B2 7/2009 Rubin et al.
8,505,348 B2 * 8/2013 Colasse ..... A62B 3/005 206/234
2009/0265858 A1 * 10/2009 White ..... A62B 3/005 7/158

* cited by examiner

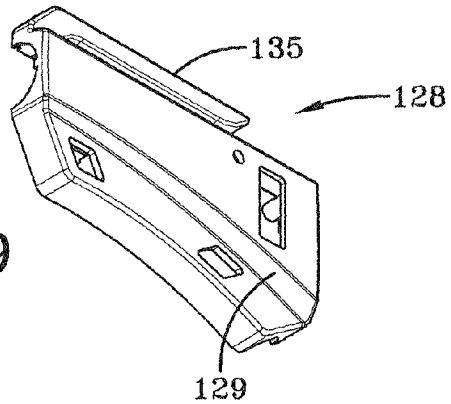
FIG-19
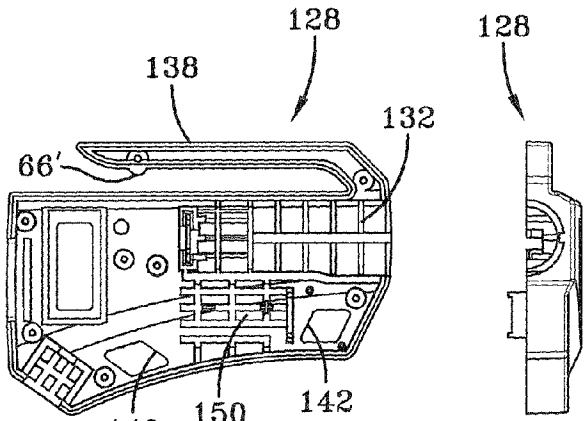
FIG-21
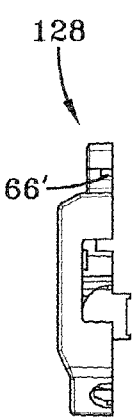
FIG-22
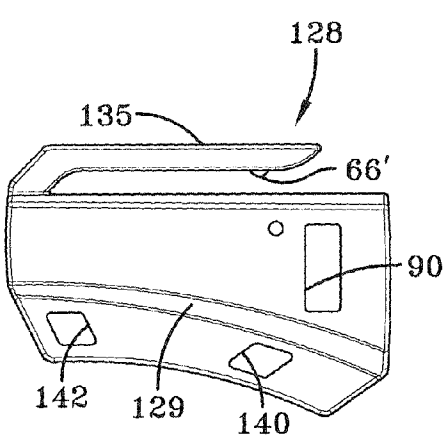
FIG-20
FIG-23

AUTO EMERGENCY TOOL

CROSS REFERENCE TO RELATED APPLICATION

This application claims the benefit of U.S. provisional patent application Ser. No. 61/787,203 filed Mar. 15, 2013, under Title 35, United States Code, Section 119(e), which is incorporated herein by reference in its entirety.

BACKGROUND OF THE INVENTION

1. Field of the Invention

This invention relates to handheld emergency tools, and in particular to small emergency tools to enable a person to escape from a motor vehicle, such as an automobile, when the motor vehicle is in an emergency situation, and a visor clip therefor.

2. Description of the Prior Art

There are many incidences where persons in a motor vehicle, such as an automobile, require assistance to escape from the motor vehicle quickly and safely. This could occur in the event the motor vehicle was involved in a collision with another motor vehicle or with some other object, became immersed in water, caught on fire and the like. In most motor vehicles, there are two obstacles for preventing easy escape from the vehicle; these are the windows of the vehicle and the seat belt which is used to hold an occupant in place. Furthermore, a person in distress from such a motor vehicle incident requires assistance in both finding a path to escape the vehicle and to emit a signal to possible rescuers. If an occupant is unable to open a window in the vehicle as a path of escape, it would be necessary to break the window in as short a period of time as possible while requiring limited strength and range of motion, particularly if the occupant is injured, fragile, weak, and in some instances having a little time or room to break the window. Also, there may be instances where an occupant is unable to open a locked seat belt apparatus, such as in the event the operating mechanism is inoperative possibly because of an accident, because the occupant is unable to reach the release mechanism for the seat belt, because obstacles impeding access to release the operating mechanism, because the operating mechanism is malfunctioning or for some other reason cannot release the seat belt.

Commonly owned U.S. Pat. No. 7,557,720, entitled "Personal Emergency Device," is directed to a personal emergency device which can be kept on a keyring and is useful in various emergency functions, such as those directed to emergency situations involving automobiles. This device has been found very useful because it is small and provides a device for cutting an automobile vehicle's seat belt webbing in the event the driver or passengers are unable to unfasten their seat belts, it includes a device for breaking tempered, unlaminated automobile side window glass by means of a spring-actuated pin having a sharp point that is driven into the glass to break it and which automatically resets for further use. The foregoing device also includes electronically operated items including a high beam and low beam LED flashlight, an emergency red LED light flasher, a thermometer, a digital tire gauge and an audible alarm. While the latter device, which is currently on the market and sold as a Swiss+Tech BodyGard® 7-in-1 Automobile Emergency Tool, its illumination could be brighter considering the emergency situation in which it could be involved, such as a warning signal and/or to illuminate a path of escape, and its battery life could advantageously be extended. Additionally, its ergonomics could be improved.

Another automobile emergency tool was marketed by the applicant under the name Swiss+Tech BodyGard® ESC 5-in-1 Automobile Emergency Tool. This was an ergonomic device which was small enough to be held on a keychain, and had a glass breaker, a seat belt cutter, a sonic alarm, an LED flashlight and an emergency red LED light flasher. Subsequently introduced to the market was a device entitled Swiss+Tech BodyGard® PTX Auto Emergency Tool. The latter tool is the subject of International Publication No. WO 2013/122604 A1. The latter device is an ergonomic auto emergency tool having a glass breaker, a seat belt cutter and an LED flashlight. The latter device is relatively small compared to the two auto emergency tools discussed above. Each of the foregoing products marketed by the applicant have a razor-sharp safety blade for cutting a seatbelt, and a blade cover slides in and out over the blade to protect the blade and to avoid unintentional cutting when the blade is not in use for cutting a seat belt. The foregoing BodyGard® 7-in-one Auto Emergency Tool has a sonic alarm, which is turned on and off by the pressing of a button. It can be deactivated by simply removing the user's hand from the button but keeps generating a warning signal for a period of time.

There are other similar devices which have serious setbacks. U.S. Pat. No. 5,657,543, entitled "Emergency Tool," is directed to a device which is large and bulky, and is for use by emergency personnel having a spring-loaded, trigger operated impact member for breaking glass in a vehicle. The device has an emergency glass-breaking tool, a pivotal knife blade, but no warning or alarm member. The device is fairly large, and would fill up a user's hand. Another known device is described in U.S. Pat. No. 5,952,916, entitled "Hammer Equipped Emergency Signal Device," having an LED for emitting a warning light, an alarm buzzer and a pair of percussion imparting members which must be swung as a hammer to break the glass. This device is large, requires space to operate and expensive for one to buy. Another device is shown in U.S. Pat. No. 6,418,628, which is allegedly small enough to be carried on a keychain, in a pocket or a purse and includes a spring-loaded glass breaker. It also includes a V-shaped razor blade for cutting a seat belt. This device does not have a light of any sort.

There are other devices known which are of general interest. Referring to U.S. Pat. No. 4,209,870, there is disclosed a handheld cleaning device having a cleaning section and an illuminating system for acting alternatively as a flashlight or as a beacon. An aiming post light is disclosed in U.S. Pat. No. 4,290,095. This light is used for artillery and mortar operations at night, and can be used to provide either steady light or a blinking light, and the blinking light could be red or green, which could be used to assist colorblind operators to distinguish between the two colors. An emergency flashlight is described in U.S. Pat. No. 7,033,042. This apparatus has a flashlight body with a battery storage unit and incorporates a hook member for supporting the flashlight on various objects, such as a belt or a handle ring of handbag. It also has a glass-cutting edge with a hammer piece which can be used to cut, strike and break glass and other debris during an emergency situation. None of the latter three devices are small enough to be easily held in a pocket, handbag or on a keyring.

SUMMARY OF THE INVENTION

An object of the present invention is to provide an emergency tool for use in motor vehicles, such as automobiles, which is ergonomic and easy to handle in emergency situations, provides the features of an easily accessible cutting tool for cutting seat belts, easy-to-use with an instant reset glass breaker for breaking the tempered, unlaminated glass windows of motor vehicle in times of an emergency, and a compact yet brighter light than previous similar devices which can be used for enabling the user to detect things in dark places and as a flashing signal device.

Another object of the present invention is to provide an improved emergency tool which is small enough to be held in a person's pocket, such as on a keyring, or in a handbag, or in an easily accessible place in a motor vehicle.

It is still another object of the present invention to provide a miniature auto emergency tool which provides the functions of being a seat belt cutter, a glass breaker and an illumination signal device, a tire air pressure gauge and a tire-tread-depth indicator.

It is still another object of the present invention to provide an auto emergency tool as discussed above having simple electronics without the necessity for a functionally complicated circuit board or for batteries larger than disc batteries and can be made and sold relatively inexpensively compared to other vehicle emergency escape tools.

It is further an object of the present invention to provide an easy to use tire-tread-depth mechanism which does not increase the dimensions on the auto emergency tool.

Another object is to provide easily accessible, manually operable and compact switches to operate the flashlight and warning signal, an audible alarm and a digital tire pressure gauge.

A still further object of the present invention is to provide an automobile emergency tool having a pair of red LEDs for sending out strong emergency illumination rather than a single red LED.

Another object of the invention is to provide a flashlight/flasher operating device with a button which is pressed one time to operate the flashlight, twice to operate the pair of LED flashers, and a third time to turn the illumination devices off.

Another still further object of the present invention is to provide a sonic alarm with the actuating button for actuating the alarm when the button is depressed, and for delaying the cessation of the alarm for a period of time after the button is released to assure that an audible warning signal is generated even if the alarm is grabbed by an assailant.

It is also an object of the present invention to provide a digital tire gauge which can be voluntarily changed between a psi scale and a bar scale.

It is also a still further object of the present invention to provide a tire gauge indicator which is easily read by means of color indicators on the gauge.

A yet further object of the invention is the provision of a releasable blocking mechanism for blocking the inadvertent removal of a blade cover from a blade in an auto emergency tool.

It is yet another object to provide an auto emergency tool having a pair of warning flashers.

An additional object of the invention is the provision of an auto emergency tool as defined herein along with a visor storage clip which also serves as a blade cover.

It is yet a further object of the present invention to provide an auto emergency tool having the features indicated above, including the visor storage clip, which is durable, effective in use and able to withstand detrimental conditions, such as water immersion.

These and other objects of the present invention should occur to those skilled in the art from the following description, the accompanying drawings and the claims.

The foregoing objects are achieved according to the preferred embodiment of the invention which includes a housing having a main portion and a projecting portion extending from the main portion at a joining section. The main portion and the projecting portion are spaced apart to define a recess or notch. A knife blade extends between the main portion and the projecting portion adjacent to the joining portion, the blade having a razor sharp edge. The projecting portion is configured so that in one motion a person can operate the auto emergency tool to break a vehicle window and then cut a seat belt. A blade cover can be slid in the notch and be guided by cooperating structure on the blade cover and the housing to follow a longitudinally extending path and slide the blade cover into the notch. A slit in the blade cover admits the knife blade as the blade cover enters the notch, and an indented channel in the blade cover receives a dimple or protrusion from the projecting portion of the housing to releasably guide the blade cover to a blade covering position. A recess in the blade cover receives the dimple when the blade cover is in the fully-inserted or closed position to prevent the inadvertent removal of the blade cover from its closed position. The blade cover can easily be pulled from the notch by means of a keyring extending through a hole in the key cover. The blade cover has an easy-to-use tire tread-depth gauge. The tread-depth gauge is incorporated at an end of the blade cover which is proximal the blade when the blade cover is in its closed, inserted position and is protecting the blade. The tire tread-depth gauge has three striped bars, the bar closest to the end of the blade cutter is red, showing that it is time to change the tire. The next bar is yellow, which serves as a warning that the tire tread is substantially worn, and the innermost bar is green indicating that the tire tread is satisfactory. At one end of the auto emergency tool is a translucent LED lens, behind which (i.e. towards the front of the tool) is an LED light and a pair of LED warning lights, and at the other end is a glass breaking mechanism including a guide piece for a spring-loaded impact pin which is released when the guide piece is firmly pressed against the vehicle window to break the glass and enable an escape from the vehicle. The flashlight/flasher lights are operated with a single button. The button is pressed once to actuate the LED flashlight, and the button is actuated twice in order to actuate the pair of LED red flashers, which blink on and off, until the button is pressed a third time, which turns the lights off. The glass breaking mechanism includes components for automatically resetting the mechanism. The actuating switch for the flashlight and flashers is on the lower side of the main body, opposite from the blade and notch, adjacent the LED's for turning the light on and off. An audible alarm switch is also on the lower side, near the glass breaking mechanism. The audible alarm switch is a single button, which upon being pressed actuates an audible alarm. Once the pressure on the button is released, the alarm keeps emitting an audible, loud signal for a period of time to alert others in the area that an assailant may have attacked the user, and the assailant would be unable to immediately deactivate the alarm serving both as a warning and to possibly cause the assailant to flee. The auto emergency tool is ergonomic and can easily be held and operated, as well as being stored while taking up little room and causing no discomfort even if stored in one's pocket. The operation of the blade to cut a seat belt and the operation of the glass cutter are so positioned to enable the breaking of the glass and the cutting of the seat belt possible in basically a single motion. The batteries for the LED are small disc batteries, and the battery compartment in the main portion extends longitudinally in the tool. The tire air pressure nozzle is located below the LED lens, and due to a curvature in the lower part of the tool, is very accessible for receiving a tire nozzle. The battery cover can easily be opened by means of a captive screw, which is not removable. An optional visor clip can be used to attach the wide flat surface of the auto emergency tool to the visor of the automobile. The visor clip incorporates a blade cover that is configured much like the blade cover for insertion into the blade notch, thus facilitating the withdrawal of the auto emergency tool from the visor clip. The auto emergency tool is small in size, effective in operation and less expensive than other similar tools presently available.

BRIEF DESCRIPTION OF THE DRAWINGS

FIGS. 19-23 are, respectively, exterior perspective, exterior side, interior side, front and rear views of the housing front portion according to the preferred embodiment of the invention.

DETAILED DESCRIPTION OF THE PREFERRED EMBODIMENT

The automobile emergency tool as discussed in the present application is an ergonomic tool which is easy to hold and operate, and is small enough to easily be held in a user's pocket, handbag or the like. It is attractive in appearance and can be made to operate for a long period of time in an inexpensive manner. A visor clip is also described for holding the inventive auto emergency tool.

Figure 1:
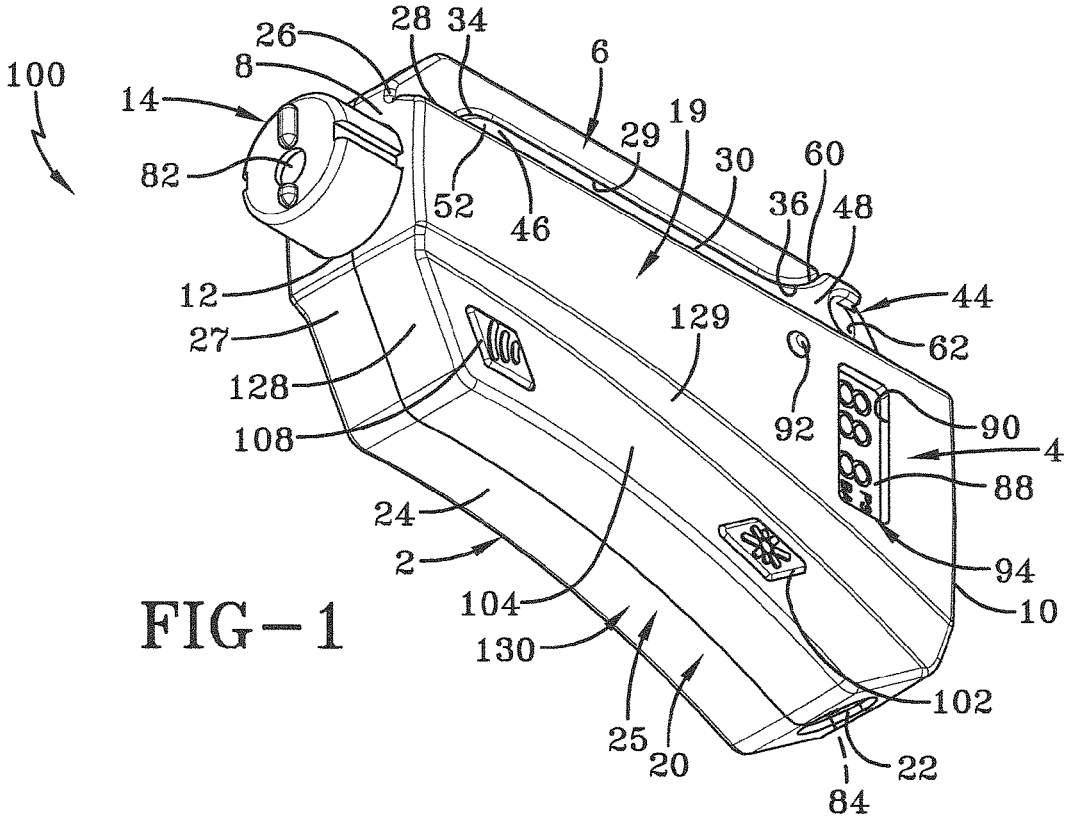
FIG. 1 is a bottom, front perspective view of the auto emergency tool according to the preferred embodiment of the invention.
Figure 2:
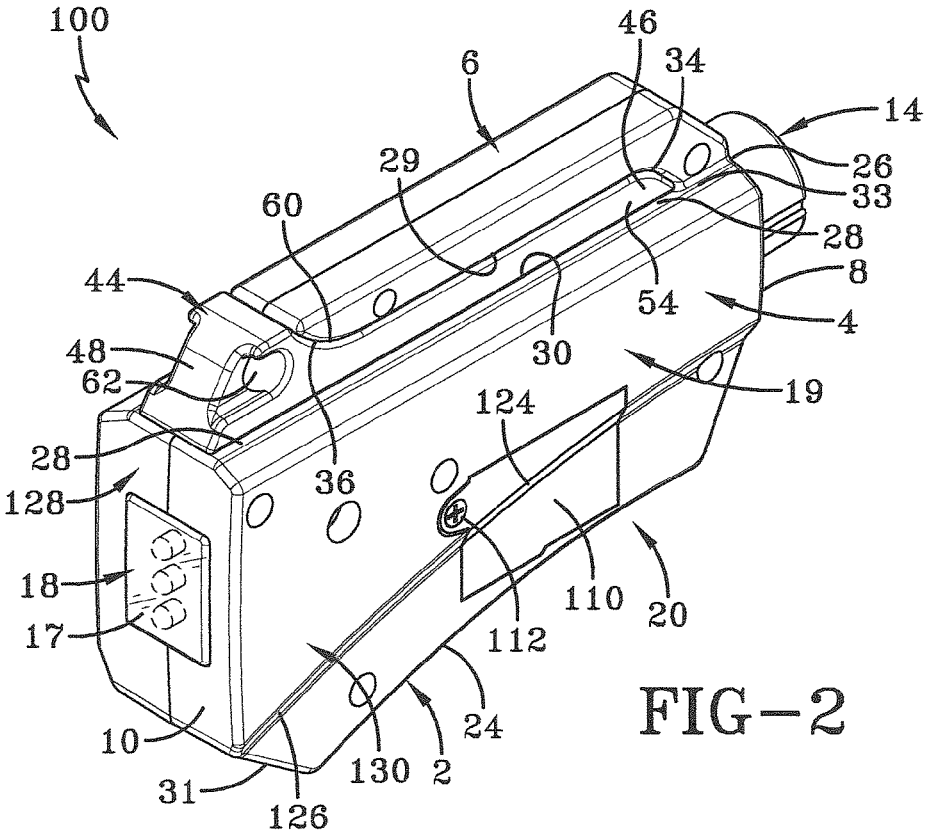
FIG. 2 is a rear, top, perspective view of the auto emergency tool according to the preferred embodiment of the invention.
Figure 8:
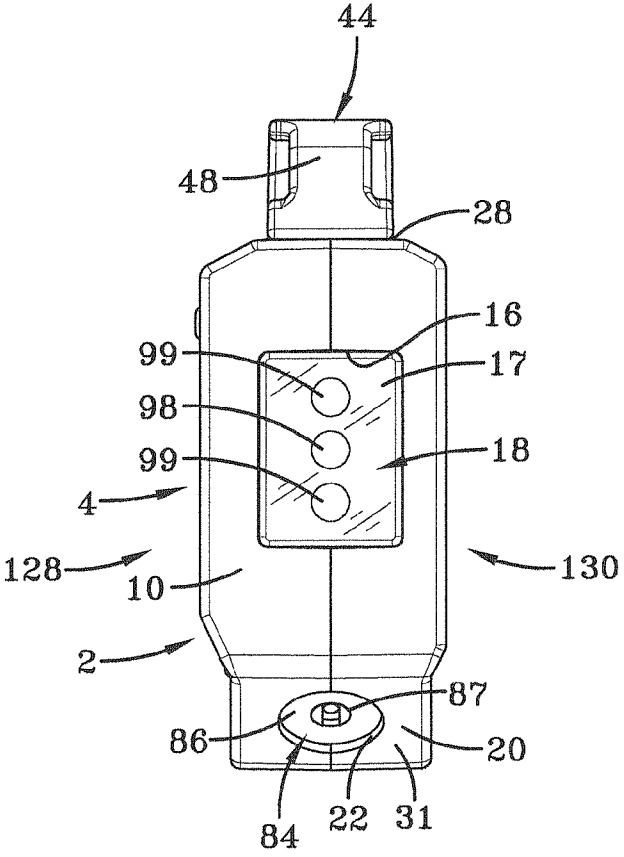
FIG. 8 is a rear view of the auto emergency tool according to the preferred embodiment of the invention.

Turning first to FIGS. 1-2, an auto emergency tool 100 is shown. Auto emergency tool comprises an ergonomic housing 2 having a main housing portion or main portion 4 and a projecting portion 6 which is integral with main portion 4. Main portion 4 has a forward end or generally flat front surface 8 and a rearward end or generally flat rear surface 10. As shown in FIG. 7, forward end 8 has a circular opening 12 for receiving part of a glass-breaker assembly 14 (shown in the exploded view of FIG. 6) described below. As shown in FIG. 8, rearward end 10 of main portion 4 of housing 2 has a flashlight and flasher opening 16 for receiving an LED lens 17 of an illumination assembly which advantageously is a flashlight and flasher assembly 18.

Main portion 4 has an upper portion 19 with a relatively large thickness $T_1$. $T_1$ is advantageously about ¾ inch wide. Main portion 4 of housing 2 has a lower portion or rearwardly inclined rearward bottom surface 20 with a tire gauge nozzle opening 22. The latter is shown in FIGS. 1 and 8. Lower portion 20 has a bottom surface 25. Bottom surface 25 has a centrally-disposed concave portion or finger-grasping curved surface 24 which is so configured that a person can grasp auto emergency tool 100 at curved surface 24 and hold the person's thumb along the length of projecting portion 6 to firmly hold auto emergency tool 100 in position for use. Lower portion 20 has relatively thin thickness $T_2$, $T_2$ is advantageously about ⅝ inch wide. Curved surface 24 is concave and ergonomic to render auto emergency tool 100 effective in use. The radius of curved surface 24 has been found to be at or about 3½ inches. Bottom surface 25 further has an inclined forwardly-disposed surface 27 interconnecting surface 25 with forward end 8, and an inclined rearwardly-disposed surface 31 interconnecting surfaces 25 and rearward end 10.

Projecting portion 6 is integral with main portion 4 of housing 2 and extends from main portion 4 at a projecting portion juncture 26. Main portion 4 has a main housing top surface or upper portion 28 which is generally flat and has a forwardly-disposed main top portion 33 and a projecting portion junction 26. Juncture 26 is at upper portion 28 and at forward end 8. Projecting portion 6 has an interior or inner surface 29 opposite to a main portion upper surface or generally flat housing top portion 30. A portion of the latter surfaces is shown in FIGS. 2 and 4. Projecting portion 6 has a uniform projecting portion height 32, a concave forward-projecting surface having an initial curve 34 near juncture 26, and a concave rearward portion surface or curved end 36 at its free end, which is curved oppositely from a curved surface 34 proximal juncture 26. Curved surfaces 34 and 36 can be seen, for example, in FIGS. 1-4. Interior surfaces 29 thus has a generally flat intermediate projection portion surface interconnecting the concave forward projecting surface and the concave rearward-projecting portion surface.

Figure 3:
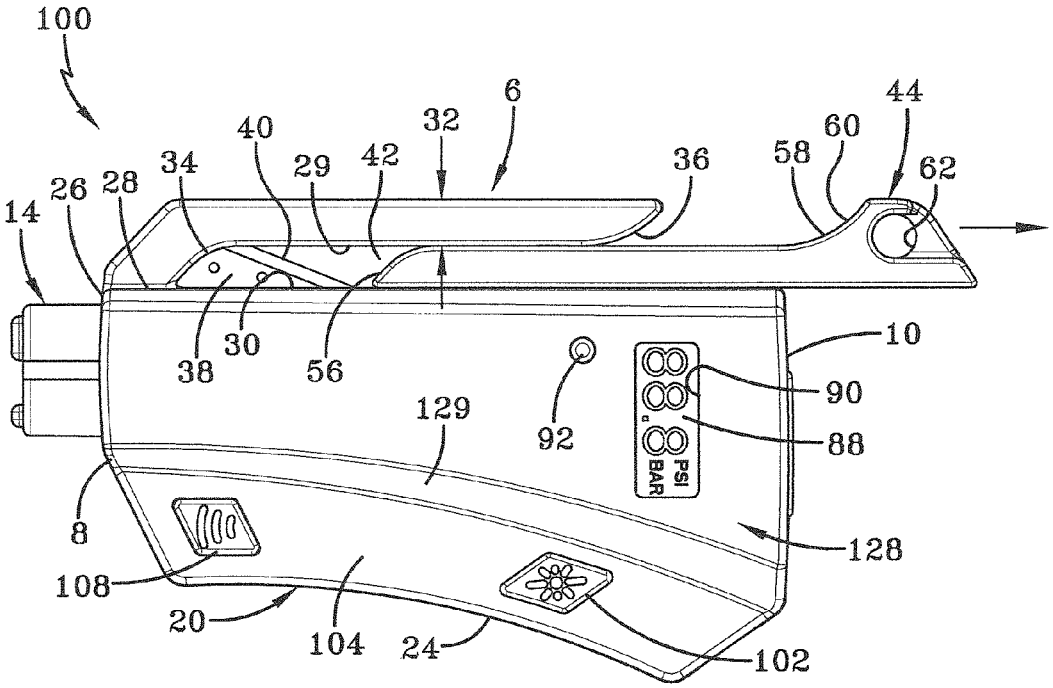
FIG. 3 is a side view of the auto emergency tool according to the preferred embodiment of the invention, with the blade cover being partially removed.
Figure 4:
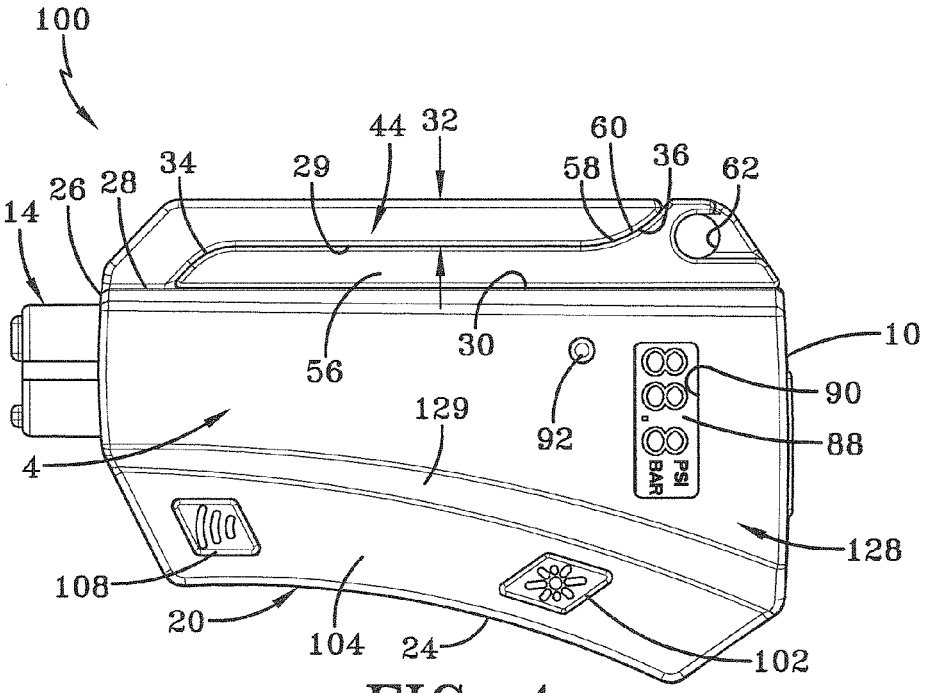
FIG. 4 is the same side view of the auto emergency tool shown in FIG. 3 with the blade cover fully installed.

An inclined seat belt cutter blade 38 extends in the space between inner surface 28 of projecting portion 6 and inner surface 30 of main portion 4, which extends from the area adjacent juncture 26 and is inclined rearwardly and downwardly, spanning projecting portion height 32 closest to juncture 26 and reaching a 0 (zero) height distal juncture 26, as shown, for example, in FIG. 3. Blade 38 has straight, inclined portion 40, which extends between inner surface 29 of projecting portion 6 and inner surface 30 of main portion 4, and makes an interior angle of about 20° with the surface defining inner surface 30.

The space between inner surface 28 of projecting portion 6 and inner surface 30 of main portion 4, or the projecting portion interior surface 29 cooperating with the top surface 28, defines a seat belt receptacle 42 (FIG. 3) for receiving a seat belt in a manner discussed below. A portion of seat belt cutter blade 38 is located in seat belt receptacle 42 at the forward end of auto emergency tool 100.

Figure 5:
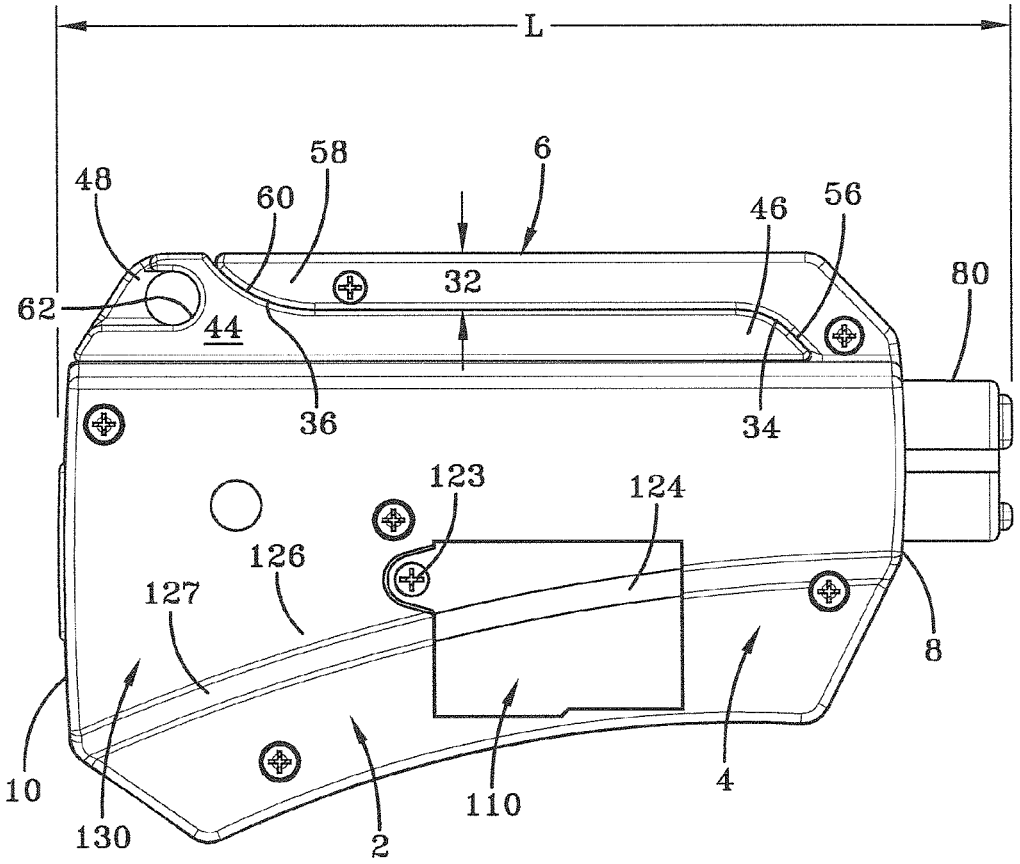
FIG. 5 is aside view of the auto emergency tool on the side opposite from that in FIGS. 3 and 4.
Figure 9:
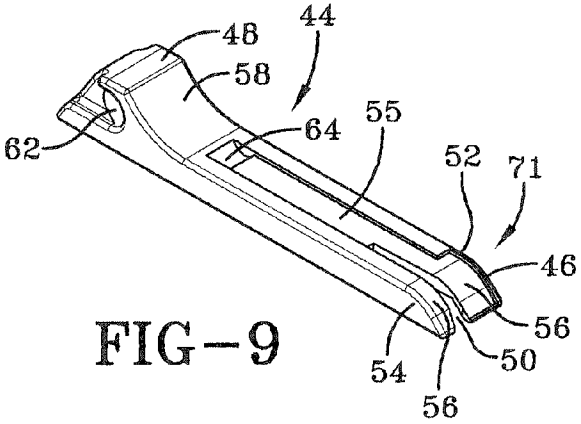
FIGS. 9, 10, 11 and 12 are perspective, top, side and end views of the blade cover according to the preferred embodiment of the invention.
Figure 12:
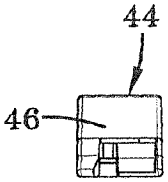

A blade cover 44 is insertable into seat belt receptacle 42. Blade cover 44 has a forward end portion 46 and a rearward end portion 48. Blade cover 44 has a notch or slit 50 (FIGS. 9 and 10) located in its forward end portion 46, which is defined by a pair of opposing blade cover sections 52 and 54. Cover sections 52 and 54 constitute an elongated recessed portion 55 which terminates at recess 64. Blade cover 44 has a curved surface 56 at its forward end 46 which is configured to snuggly engage curve 34 of projecting portion 6 with blade 38 inserted into notch 50. Blade cover 44 has an upwardly curved rearward end 58 at the portion of blade cover 44 when fully inserted in notch 50, which has the same curve 60 as curve 36 of projecting portion 6 so that curved rearward end 58 is in snug contact with curved surface 36 of projecting portion 6, as shown in FIGS. 2, 3 and 5. Rearward end portion 48 of blade cover 44 has a keyring hole 62 for receiving a keyring. When a keyring is installed on blade cover 44 through keyring hole 62, this combination has two important purposes. First, it enables auto emergency tool 100 to be attached to a keyring or to some other device which can fit through hole 62, and further to facilitate the fast withdrawal of blade cover 44 in the event one wants to use seat belt cutter blade 38.

Figure 10:
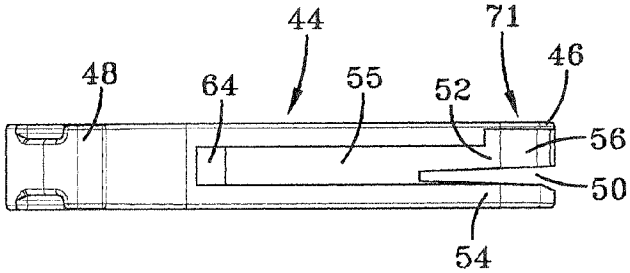
Figure 11:
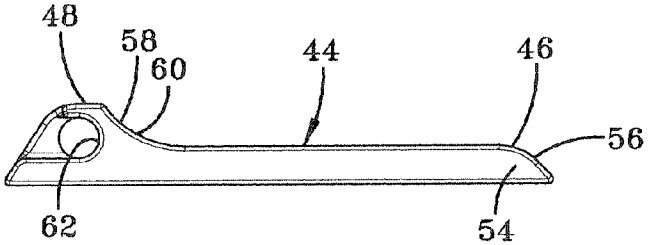
Figure 13:
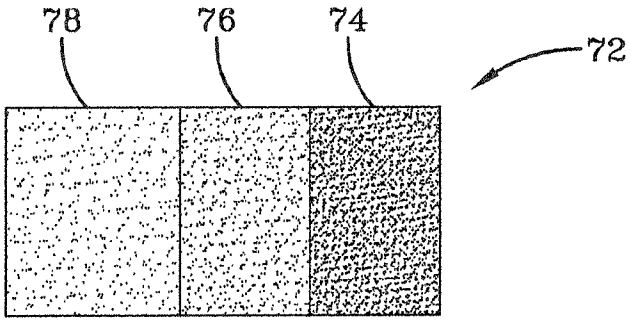
FIGS. 13 and 14 are front and side views of the decal for the tread-depth gauge according to the preferred embodiment of the invention.
Figure 14:
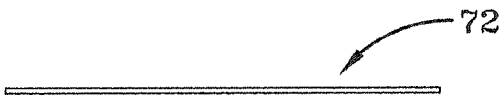
Figure 15:
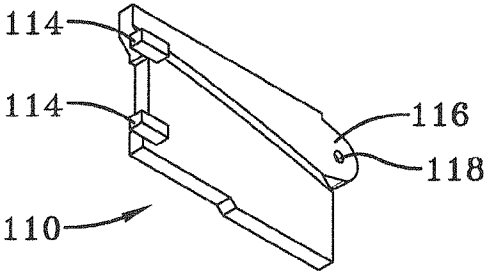
FIGS. 15-18 are an interior perspective, an interior side, an exterior side and end views of a battery door used on the auto emergency tool according to the preferred embodiment of the invention.
Figure 17:
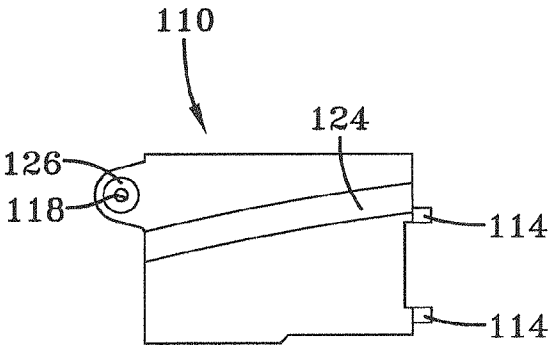
Figure 18:
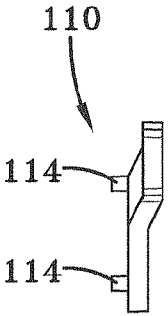
Figure 16:
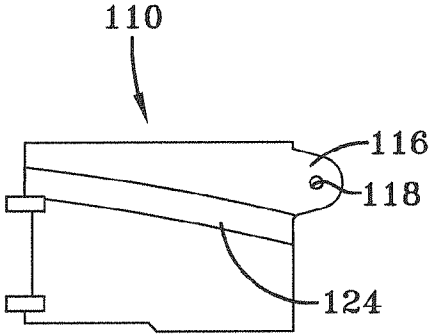

Recess 64 is provided in blade cover 44 for receiving a guiding projection or protuberance 66 extending downwardly from inner surface 29 of projecting portion 6 (halves of which are shown as 66' and 66" in FIGS. 20-22, 25 and 28). As blade cover 44 is slid into seat belt receptacle 42, protuberance 66 remains in elongated recess portion 55 and accurately guides blade cover 44 into receptacle 42. When blade cover 44 is fully inserted or installed in receptacle 42, protuberance 66 drops into recess 64. The cooperation of recess 64 and protuberance 66 prevents the inadvertent removal of blade cover 44 from seat belt receptacle 42. Cover section 52 of blade cover 44 is wider than blade cover section 54, as shown in FIG. 10. Blade cover section 52 is also a tire tread-depth indicator 71. A decal 72, shown in FIGS. 13 and 14, is attached the forward end of cover section 52. Decal 72 is marked to show whether a tire tread has appropriate depth or not. In the preferred form of the invention, decal 72 has a red portion 74 at the free end of blade cover 44, and adjacent yellow portion 76 and a final contiguous green portion 78 which is furthest from forward end portion 46 of blade cover 44. One uses the tire tread-depth indicator by removing blade cover 44 from seat belt receptacle 42 and positioning cover section 52 into the space between two treads of a tire. If section 52 can only go up to red portion 74, this indicates that the tire should be changed since the tread is too shallow. If the depth only goes to yellow portion 76, this is a warning that the tread of a tire is close to being dangerous. Finally, if the depth of the tread is indicated by green portion 78, this indicates that the tire tread depth is safe.

Glass-breaker assembly 14 is located at forward end 8 of housing 2. Only parts of glass-breaker assembly 14 are visible when auto emergency tool 100 is fully assembled. With reference to FIGS. 1 and 3-5, and glass-breaker assembly 14 includes a guide housing 80 which is visible through opening 12 in forward end 8 of housing 2. Guide piece 80 has an opening 82 for alignment with a pointed end 147 of a pin-and-guide assembly 144 as discussed below. Located in lower portion 20 of housing 2 is a tire pressure gauge assembly 84 which is disposed in tire pressure gauge opening 22. This can be seen in FIGS. 1 and 8, and gauge 84 has a pressure washer 86 for receiving the tire nozzle, which would apply tire air pressure to a tire pressure gauge nozzle 87. Auto emergency tool 100 further has a tire pressure gauge indicator 88 which is visible through an opening 90 in housing 2, as shown in FIGS. 1, 3 and 4. A pressure button 92 is located near tire pressure gauge indicator 88 and can be pressed once or twice so that indicator 88 can either give out pounds per square inch ("psi") or barometric scale readings, respectively, based on atmospheric pressure at sea level. For example, 32.2 psi at sea level equals 2.21 BAR.

Auto emergency tool 100 further has an illuminating assembly 96, which is partly visible in fully-assembled tool 100. Turning first to FIG. 8, disposed in flashlight and flasher opening 16 is an LED lens 17 having a flashlight LED 98 disposed between a pair of flasher LED's 99 disposed above and below flashlight lens 98. As shown in FIGS. 1, 3 and 5, an LED actuator button 102 located near rearward end 10 of housing 2 and on a lower part of main housing 4 in the form of a lower curved side portion 104. Operation of illuminating assembly 96 will be discussed below.

Auto emergency tool 100 further has a sonic alarm assembly 106. The only part of sonic alarm assembly 106 which is visible in a fully-assembled emergency tool 100 is a sonic alarm actuator button 108. Alarm actuator button 108 is also disposed on lower curved portion 104 and is forward of LED button 102, as shown in FIGS. 1, 3 and 4. The operation of sonic alarm assembly 106 is to be described hereinafter.

Figure 24:
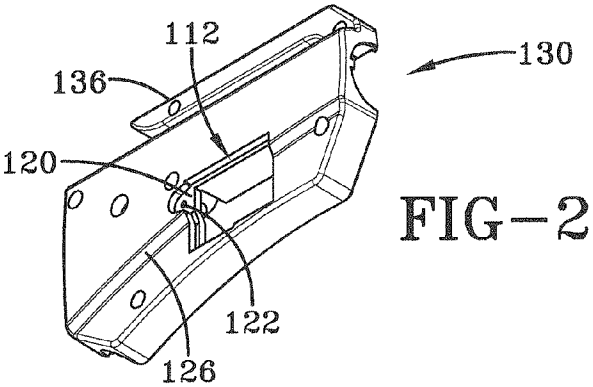
FIGS. 24-29 are respectively an exterior perspective, a side exterior, a front, a rear, a side interior and top views of the housing back portion according to the preferred embodiment of the invention.
Figure 25:
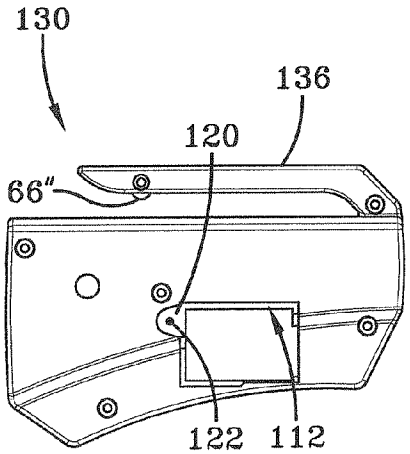
Figure 26:
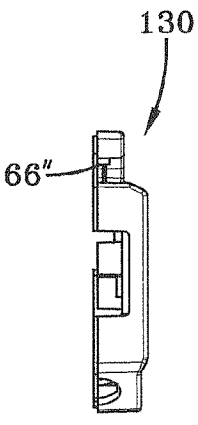

With reference to FIGS. 2 and 5, main portion 4 of housing 2 has a battery door 110. Battery door. 110 houses a battery compartment, as described later. Battery door 110 is shown in FIGS. 15-18 and is configured to fit snugly in a frame 112 shown in FIGS. 24 and 25. Battery door 110 has a generally rectangular shape with a pair of arms 114 configured to be received on the interior of frame 112. Battery door 110 has a protrusion 116 with a screw hole 118, and protrusion 116 fits snugly in a receptacle 120 of housing 2. Receptacle 120 has a screw hole 122 in alignment with screw hole 118. A captive screw 123 (FIG. 5) is screwed into screw holes 118 and 122 to fix battery door 110 to housing 2. Battery door 110 further has an exterior part 124 of an inclined, concave shoulder 127 which extends across housing 2. The other side of housing 2 has a corresponding inclined, concave shoulder 129. The user can use shoulders 126 and 129 as a finger rest when holding emergency tool 100 for use.

Figure 28:
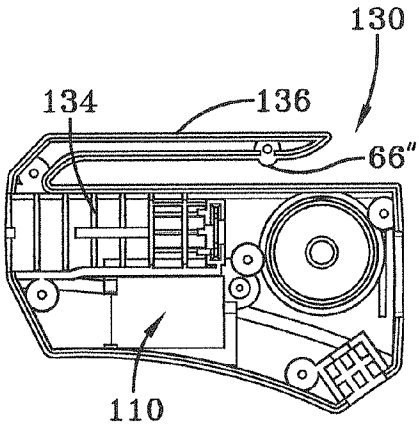
Figure 27:
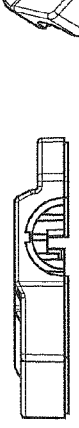
Figure 29:
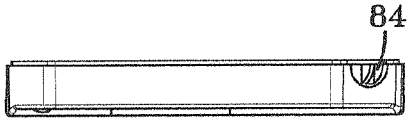

With reference to FIGS. 1-2, 7-8, and 19-29, ergonomic housing 2 includes a housing front portion 128 and a housing back portion 130. The exterior of housing back portion 130 is shown in FIGS. 2, 5, 24-27 and 29, which is part of the ergonomic housing 2. The interior of housing back portion 130 is shown in FIG. 28. It will be understood that housing front portion 128 and housing back portion 130 are sealed together to form housing 2. Housing front portion 128 has a set of ribs 132 which support portions of glass-breaker assembly 14 as shown in FIG. 21. Housing back portion 130 has a similar set of ribs 134, as shown most clearly in FIG. 28. Housing back portion 130 has a projecting portion half 136 which, when combined with projecting portion half 138 which is part of housing front portion 128, together form projecting portion 6. Each of housing front portion 128 and housing portion 130 are made of molded plastic, with the respective parts working together to hold the respective components of auto emergency tool 100 in place, as shown in FIGS. 1-2.

Referring to FIGS. 19-23, housing front portion 128 is shown. Considering first the exterior view, it has opening 90 for tire pressure-gauge indicator 88. An opening 140 receives LED button 102, and an opening 142 receives alarm actuator button 108. The other components of housing front portion 128 are provided to cooperate with corresponding components of housing back portion 130 to snugly and firmly hold the various parts of auto emergency tool 100.

Figure 30:
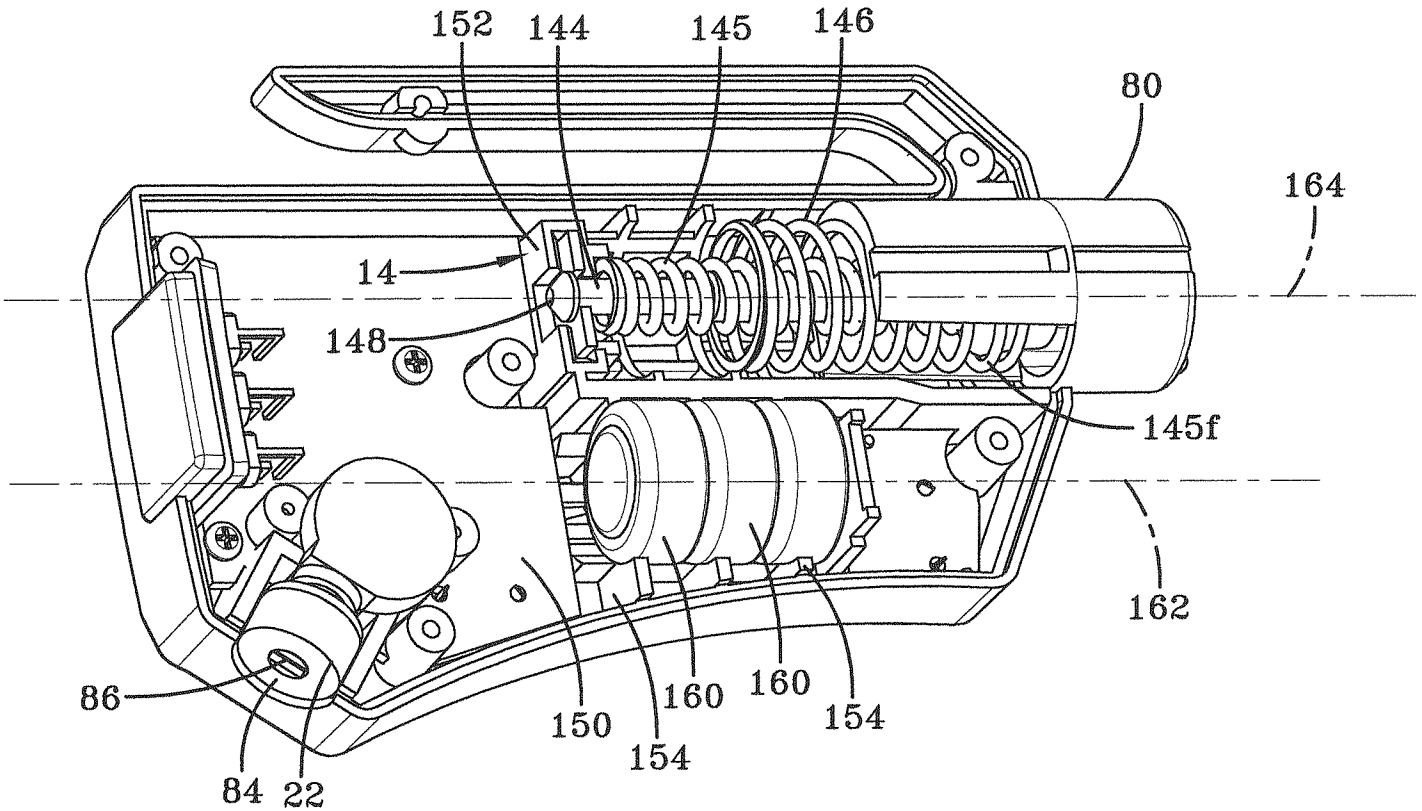
FIG. 30 is a rear, side perspective cut-away view of the invention in its preferred form.
Figure 31:
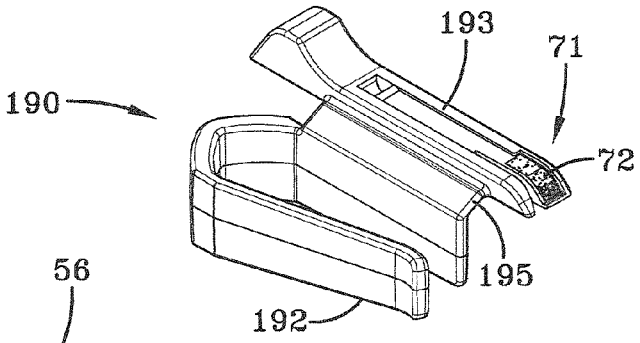
FIGS. 31-35 are perspective, one side, bottom, opposite side and end views, respectively, of a visor clip which can be used with the preferred embodiment of the invention.
Figure 34:
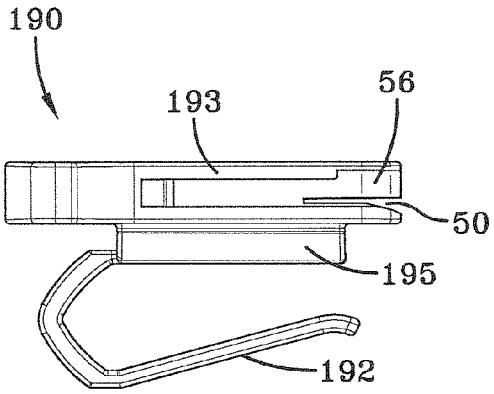
Figure 33:
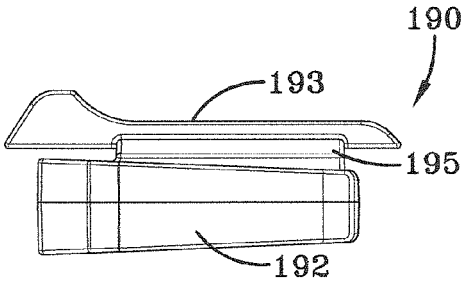
Figure 35:
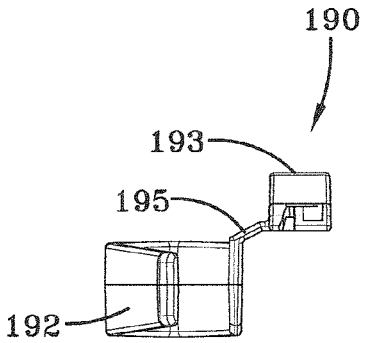
Figure 32:
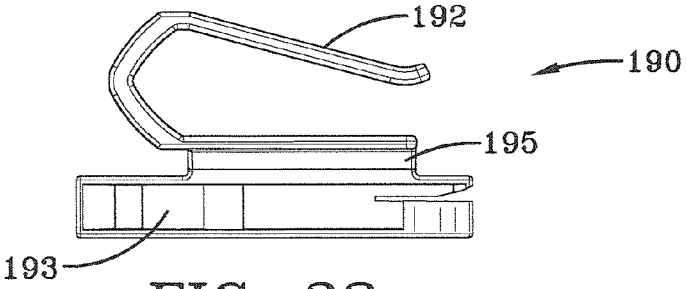

Glass-breaker assembly 14, shown most clearly in FIGS. 5 and 30, includes guide piece 80, a pin-and-guide assembly 144, a force spring 145 and a reset spring 146. Guide piece 80 is a guide for pin-and-guide assembly 144 which is used for breaking an automobile window, and preferably a side window, in emergency situations where one in a motor vehicle must escape from the motor vehicle. Guide piece 80 is designed to be retractable into housing 2. Since guide piece 80 must alternately retract or extend from housing 2, it regulates the movement of pin-and-guide assembly 144. Pin-and-guide assembly 144 has a pointed end 147 that is driven into a window glass. A bulb end 148 restricts assembly 144 from separating from auto emergency tool 100. With reference to FIG. 30, pin-and-guide assembly 144 is shown in its deployed condition. Initially, when pin-and-guide assembly 144 is in its loaded state, it is disposed to form an angle of about 5° with respect to a horizontal axis through a cavity 150. Force spring 145 coaxially surrounds assembly 144 in cavity 150 to provide the driving force for assembly 144, and reset spring 146 resets glass-breaker assembly 14. When pin-and-guide assembly 144 is loaded, the rear end of force spring 145 contacts a horizontal rib 152 at only a lower portion. Contact with rib 152 causes assembly 144 and force spring 145 to pivot and re-orient from the horizontal axis to go along an inclined axis. A forward portion of force spring 145 urges against a pin guide, and forward portion of force spring 142 is anchored in the pin guide. Pin-and-guide assembly 144 and force spring 145 must be free to pivot back from an inclined axis to a horizontal axis within cavity 150, and within reset spring 146 no such pivotal motion is necessary for the resetting of reset spring 146.

Pin-and-guide assembly 144 is maintained along the inclined axis by guide piece 80. Guide housing 80 is generally tubular and has a first arcuate wall section facing assembly 144. A wall section acts as a guide for guide housing 80 when assembly 144 abuts the wall section. To release pin-and-guide assembly 144 or deployment, cavity 150 has an upper wall with a downwardly facing disengagement ramp. As glass-breaker assembly 14 is operated by pushing guide housing 80 against glass, guide housing 80 retracts into housing 2, and by means of an arcuate wall moves pin-and-guide assembly 144 into contact with the ramp. The ramp acts to move the pin-and-guide assembly 144 downwardly in order to align pin-and-guide assembly 144 within an opening 82 in guide housing 80. As soon as pin-and-guide assembly 144 comes into alignment with opening 82, force spring 145 becomes free to urge pin-and-guide assembly 144 out of opening 82 and into the window glass. Pin-and-guide assembly 144 ejects forwardly until bulb end 148 reaches the wall section to prevent pin-and-guide assembly 144 from leaving housing 2.

Once hand pressure on guide housing 80 is released, reset spring 146 relaxes and urges guide housing 80 to return to its unretracted, forward, ready position. The rear end of reset spring 130 is anchored in its cavity and its forward end merely presses against a second rear wall section of guide housing 80. Reset spring 146 does not extend into guide housing 80. As reset spring 146 urges guide housing 80 out to its forward position, contact between force spring 145 and the horizontal rib automatically orients pin-and-guide assembly 144 to the inclined position whereupon the pin-and-guide assembly 144 re-engages the arcuate wall to reset glass-breaker assembly 14 for further use. The operation of glass-breaker assembly 14 is essentially the same as that disclosed in U.S. Pat. No. 7,557,720 (Rubin et al, Jul. 7, 2009), and reference is made to the latter patent which is incorporated herein by reference in its entirety, especially with respect to a description of the operation of glass-breaker assembly 14.

Figure 6:
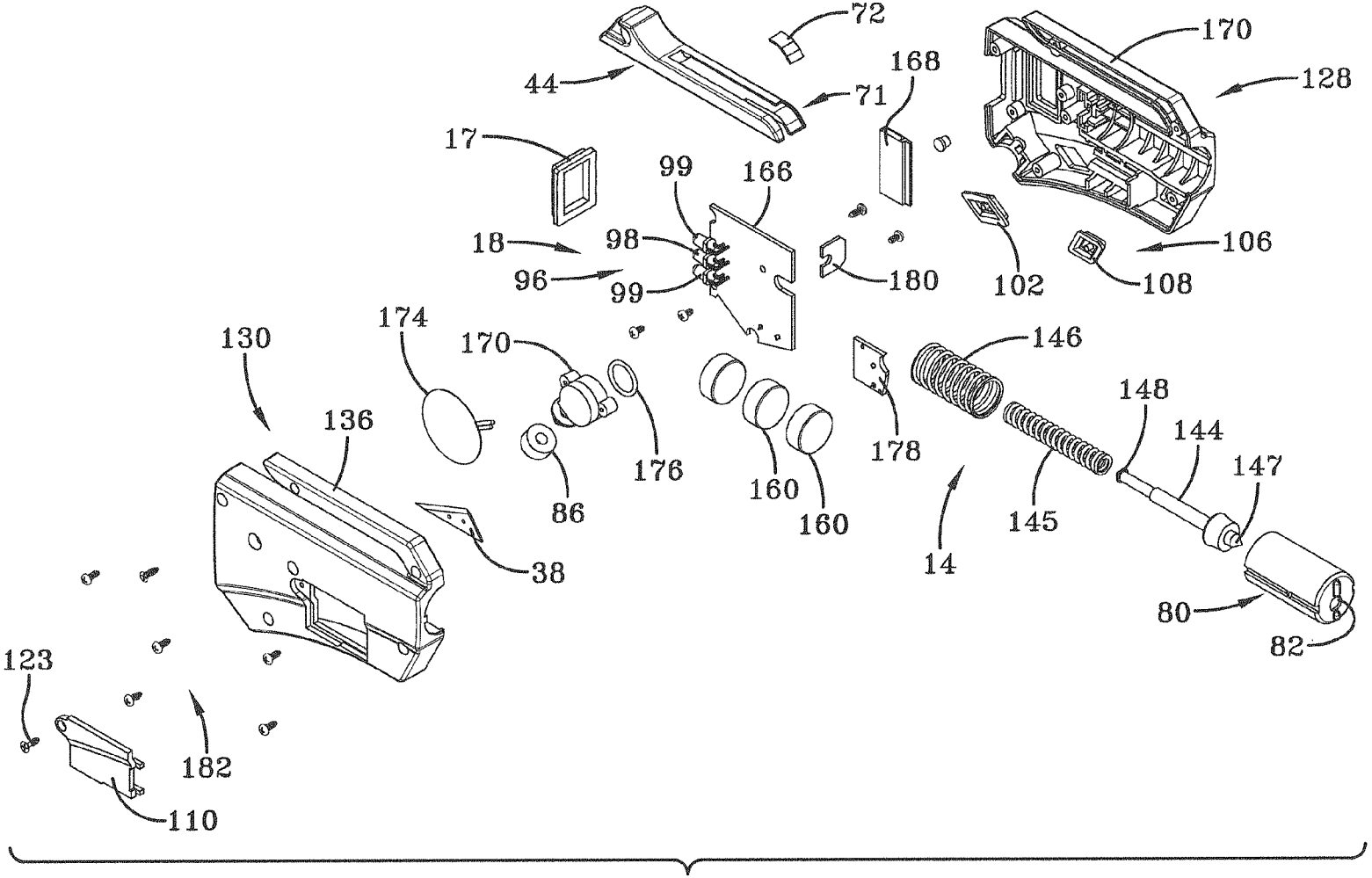
FIG. 6 is an exploded, perspective view of the preferred embodiment of the invention.
Figure 7:
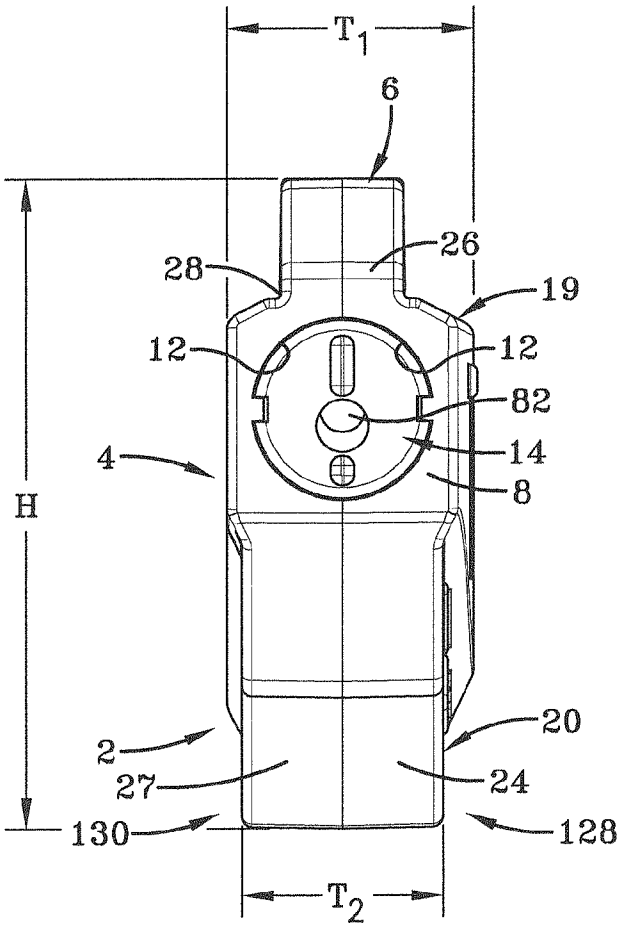
FIG. 7 is a front view of the auto emergency tool according to the preferred embodiment of the invention.

Housing front portion 128 has a battery compartment part 150 which cooperates with the interior side of battery door 10 in housing back portion 130 to hold three cell batteries 160, as shown in FIGS. 6 and 30. Battery compartment parts 150 and the interior of battery door 110 form a battery compartment to which access is available through battery door 110. A spring (not shown) is provided in the rearward part of the battery compartment to urge batteries 160 forwardly. Auto emergency tool 110 uses three cell batteries 160, cylindrical in shape, which are loaded in compartments defined by walls 144. Batteries 160 are AG13 batteries, which are compact and do not require an increase in the thickness of housing 2. A longitudinal axis 162 of batteries 160 is parallel with the longitudinal axis 164 of pin-and-guide assembly 144 when assembly 144 is in the deployed state as shown in FIG. 30.

The components of auto emergency tool 100 are shown in the exploded view of FIG. 6. Housed within housing front portion 128 and housing back portion 130 are the individual parts and subassemblies discussed above. These include glass-breaker assembly 14 and its component parts, namely, guide housing 80, pin-and-guide assembly 144, force spring 145 and reset spring 146. Blade 38 shown for mounting between a projecting portion half 170 of housing front portion 128 and projecting portion 172 of housing back portion 130. A digital tire air pressure gauge assembly is built in auto emergency tool 100, and it converts the pressure into an electric signal that the electronic circuitry analyzes and effects the generation of the measurement displayed in tire pressure gauge indicator 88. The tire pressure gauge assembly includes a pressure chamber 170, a pressure washer 86, a tire pressure liquid crystal diode (LCD) 168, an O-ring 176, pressure button 92 and, in part, main printed circuit board 166. Tire pressure liquid crystal diode (LCD) 168 provides the air pressure detected by pressure chamber 170, which is held in place by pressure washer 172. O-ring 176 is used for mounting pressure chamber 170. Printed circuit board 166 controls the operation of the various electronic systems included in auto emergency tool 100, including the display of the measurement of the tire air pressure. Printed circuit board 166 has flashlight LED 98 and red flashers 99, and they emit illumination through LED lens 17. A printed circuit board button contact 178 is in alignment with alarm button 108.

Sonic alarm assembly 106 includes an electrical circuit or circuit board button contact 178, and a piezo electric speaker 174 makes the alarm sound. Closing actuator button 108 connects the transmitter to the battery power source. Release of button 108 does not immediately put sonic alarm assembly 178 in an alarm termination mode, because the circuitry has a delay device which keeps the transmitter in an alarm transmitting mode for a predetermined period of time. LED button 102 actuates LED's 98 and 99, as discussed previously. A pin plate 180 is used as an abutment for bulb 148 of pin-and-guide assembly 144. Housing front portion 128 and housing back portion 130 are held together by various screws shown collectively by numeral 182.

Illuminating assembly 96 thus includes an electrical circuit including circuit board 166, an LED flashlight bulb 98 and a pair of flasher LED's 99. A switch device on printed circuit board 166 connects LED flashlight bulb 98 to the battery power source to illuminate bulb 198 upon a single actuation of button 102. Actuation of button 102 twice similarly connects LED flasher bulbs 99 intermittently to the battery source to cause the intermittent illumination of bulbs 99. Actuation of button 102 a third time disconnects the circuit from the battery source and turns off bulbs 99.

Auto emergency tool 100 has a number of significant advantages over the prior art. Auto emergency tool 100 can firmly and easily be held due to its ergonomic configuration. Tool 100 can very efficiently be used to both break the window of a vehicle and, in the same motion, slide a seat belt to receptacle 42 to cut the seat belt with blade 38. Tire pressure gauge 84 can be used quickly and easily to measure the air pressure in a tire, and with a simply actuation of button 48, determine the pressure in both pounds per square inch and bar. Flashlight LED 98 or flashers 99 can quickly and easily be actuated by the depression of button 102 either once or twice. The sonic alarm can be actuated by the simple pressing of alarm button 108, which continues to operate for a period of time after it is released; this avoiding the problem of having the alai in being shut off if someone were to misappropriate auto emergency tool 100 while the alarm has been actuated.

The simple removal of blade cover 44 makes available for use tire tread-depth depth-indicator 71, all without requiring an increase in the size of auto emergency tool 100. The use of three batteries 160 is an improved longer, yet brighter illumination because of their increased electrical potential over the prior art. Blade cover 144 can easily be removed by means of a keyring which offers a quick release.

Auto emergency tool 100 is compact to be easily stored in a person's pocket or handbag, yet large enough to be readily useable for its intended purposes. A preferred length L shown in FIG. 5 is about 3⅛ inches long, and its preferred maximum length is about 1 31/32 inches as shown in FIG. 7.

An auto emergency tool apparatus includes auto emergency tool 100 and a visor clip 190. A visor clip 190 shown in FIGS. 31-35 can also be a helpful accessory. Visor clip 190 has an attachment hook 192 to be slipped on a visor of the motor vehicle to hold the visor clip in place. A blade cover 193 having the same configuration and purpose of blade cover 44 renders visor clip 190 particularly helpful and puts auto emergency tool 100 in easy access should it be required. Clip 190 is attached to blade cover 193 by means of a connecting flange 195. The other components on the blade cover have the same identification numbers that were used previously in the description of blade cover 44. In order to install auto emergency tool 100 on visor clip 190, the user simply aligns the entrance to receptacle 42 with the end of blade cover 193 having the entrance to notch 50, and slide it forward until curve 34 abuts curved surface 56. To remove the emergency tool from visor clip 190, one reverses the foregoing procedure. Visor clip 190 can readily be removed from a visor to enable use of tire tread-depth indicator 71.

Figure 36:
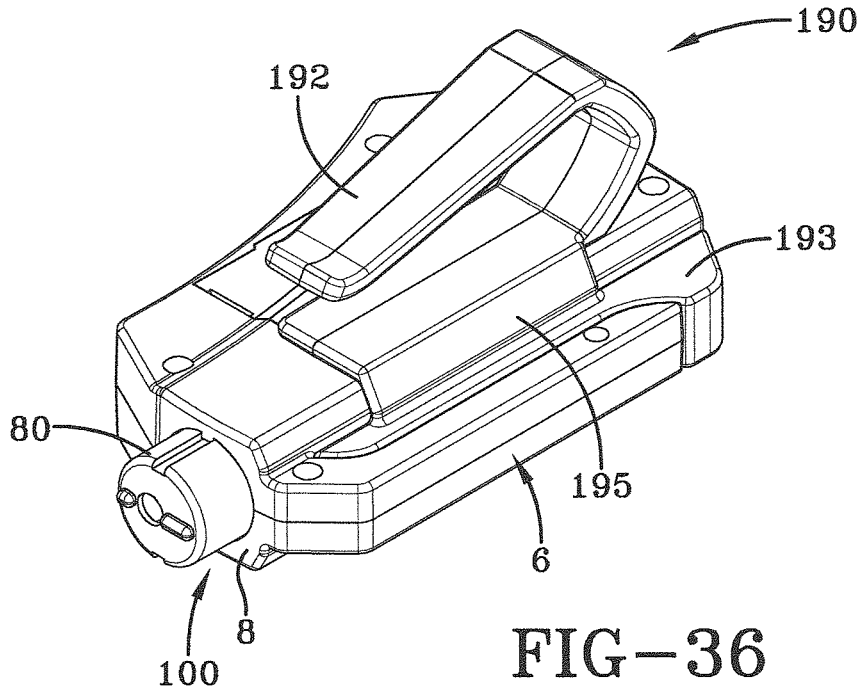
FIGS. 36-38 are top front perspective, top rear perspective and side rear perspective views of an auto emergency tool as installed in a visor clip according to a preferred embodiment of the invention.
Figure 37:
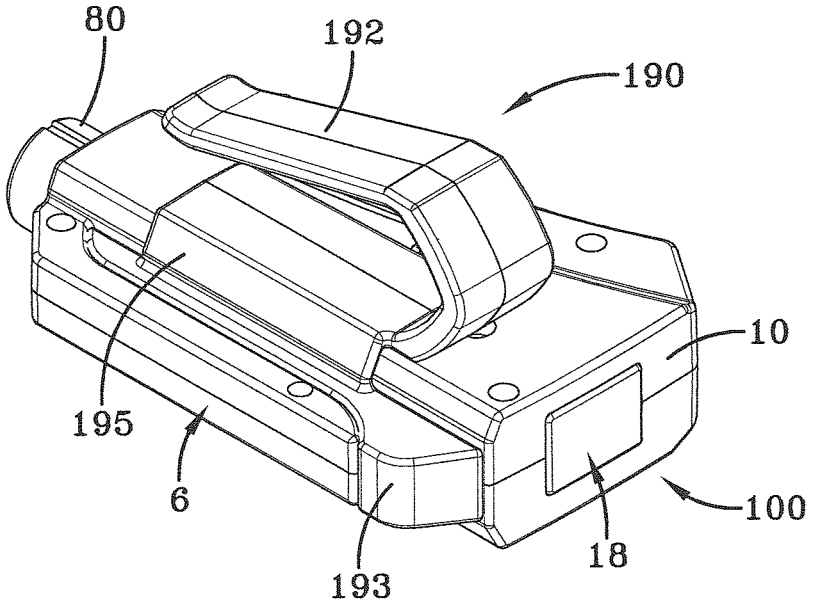
Figure 38:
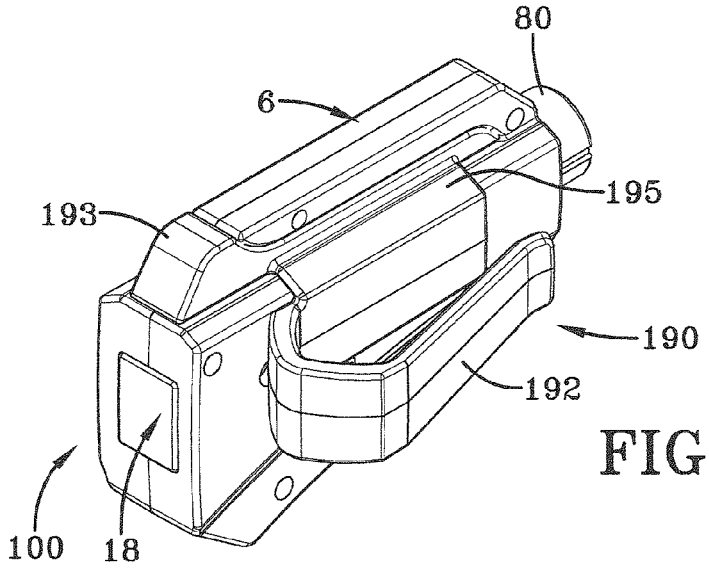
Figure 39:
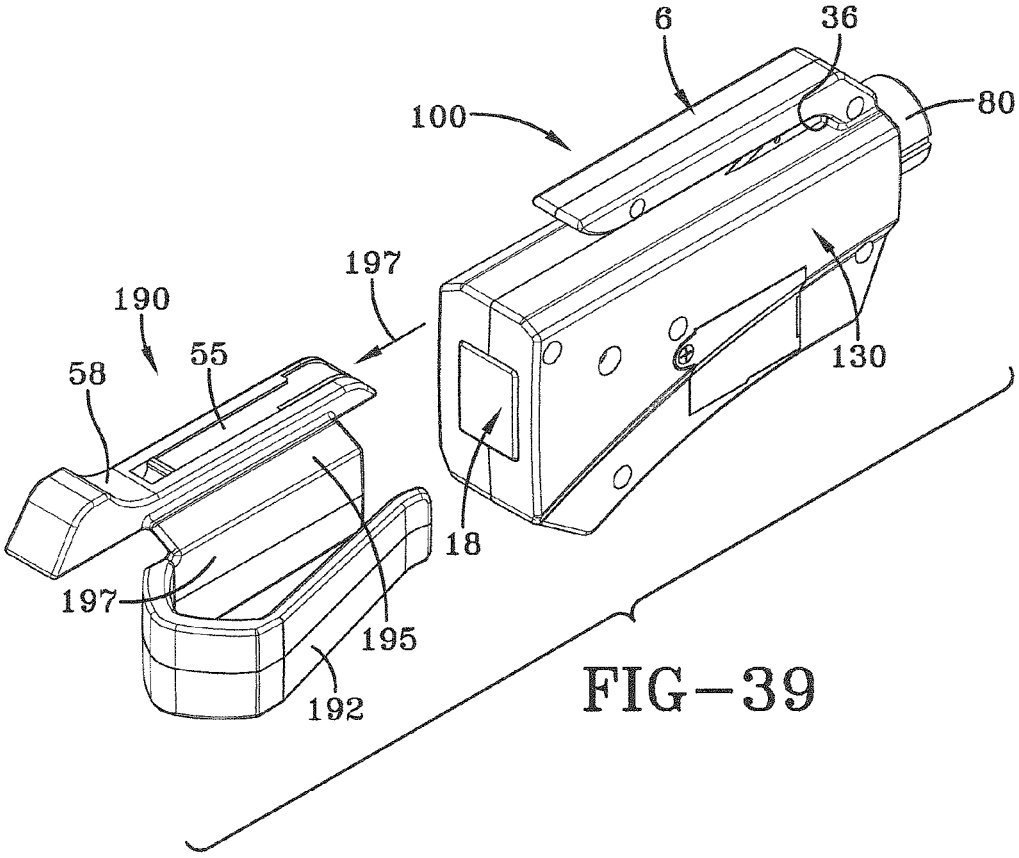
FIG. 39 is a perspective view of an auto emergency tool in the process of being installed in a visor clip to the installed condition shown in FIGS. 36-38.

Perspective views of auto emergency tool 100 installed in visor clip 190 are shown in FIGS. 36-38. Referring to FIG. 39, which shows the installation of auto emergency tool 100 on visor clip 190, visor clip 190 is clipped on a visor of a motor vehicle by means of attachment hook 192 slipped over a visor so that, in use, the view shown in FIG. 39 would be rotated 90° in the counterclockwise direction. In order to install auto emergency tool 100 on visor clip 190, one abuts the upper part of housing back portion 130 against a vertical part 197 of flange 195 which simultaneously aligns projecting portion 66 with elongated recessed portion 55. Auto emergency tool 100 is slid with its rear portion 10 moving against the rear portion of hook 192 until curve 34 of projecting portion 6 abuts curved rearward end 58 and auto emergency tool 100 being installed on visor clip 190. The direction of movement of auto emergency tool 100 onto visor clip 190 is shown by the arrow 197.

The invention has been described in detail, with particular emphasis on the preferred embodiments thereof, but variations and modifications may occur to those skilled in the art from the above description and from the appended claims.

What is claimed is:

1. An auto emergency tool comprising:

an ergonomic housing having an upper portion, a lower portion, a forward end portion and a rearward portion, said housing comprising:

a main housing portion comprising:

a housing front portion and a housing back portion; said housing front portion and said housing back portion having corresponding shapes to fit together to form said main housing portion;

a forward end having a generally flat exterior and having a glass-breaker assembly opening;

a rearward end having a generally flat exterior and an LED lens opening;

a bottom surface having a centrally-disposed concave portion, an inclined forwardly-disposed surface interconnecting said concave portion and said forward end, and an inclined rearwardly-disposed portion interconnecting said concave portion and said rearward end; and a main housing top surface being generally flat and having a forwardly disposed main top portion and a projecting portion juncture at said forwardly-disposed main top portion; and said main housing portion having a relatively large thickness at said upper portion and a relatively thin thickness at said lower portion, said upper portion having a generally flat exterior, and said lower portion having a generally flat exterior, said main housing portion further comprising an inclined concave shoulder forming a transition between said upper portion and said lower portion;

a projecting portion integrally connected to said main housing portion and extending rearwardly from said projecting portion juncture, said projecting portion having a projecting portion interior surface facing said top surface of said main housing portion, said projecting portion interior surface comprising:

a concave forward projecting portion surface;

a convex rearward projecting portion surface forming a free end of said projecting portion; and a generally flat intermediate projecting portion surface interconnecting said concave forward projecting portion surface and said convex rearward projecting portion surface;

said projecting portion interior surface cooperating with said top surface of said main housing portion to define a seat belt receptacle;

an inclined seat belt cutter blade extending across said seat belt receptacle from said projecting portion and said projecting portion juncture rearwardly to said top main housing surface;

a glass-breaker assembly disposed in said glass-breaker assembly opening of said main housing portion, said glass-breaker assembly including an external guide piece and a spring-loaded pin-and-guide assembly operably connected to said guide piece for being driven outwardly from said main housing portion in response to the depression of said guide piece into said main housing portion to break glass in the path of said pin-and-guide assembly;

an illuminating assembly comprising an LED lens in said LED lens opening, at least one LED bulb, and an illuminating assembly actuator button located in said lower portion of said main housing portion for connecting said at least one LED bulb to a battery power source;

a tire air pressure gauge assembly comprising a tire air pressure nozzle, wherein said rearwardly disposed inclined portion of said bottom surface has a tire gauge nozzle opening for providing access to said tire pressure gauge nozzle;

a blade cover insertable into said blade cover receptacle, said blade cover comprising:

a blade cover forked end with a pair of blade cover opposing sections defining a slit for receiving said seat belt cutter blade when said blade cover is inserted fully into said blade cover receptacle.

2. An auto emergency tool according to claim 1 wherein said at least one LED bulb comprises:

an LED flashlight bulb at said rearward end of said main housing portion of said ergonomic housing in alignment with said LED lens opening.

3. An auto emergency tool according to claim 2, and wherein said at least one LED bulb comprises:

at least one LED flasher bulb at the rearward end of said main portion in alignment with said LED lens opening;

and wherein said illuminating assembly further comprises:

an electrical circuit for selectively transmitting electricity to said respective LED flashlight bulb and said at least one LED flasher bulb; and an actuator for selectively electrically connecting said electrical circuit and a battery power source to one of said LED flashlight bulb and said at least one LED flasher bulb to selectively illuminate a selected one of said LED flashlight bulb and said at least one LED flasher bulb.

4. An auto emergency tool according to claim 1, wherein said blade cover has a rear blade cover flat upper surface facing a rear part of said main housing top surface, and wherein a protuberance is provided on a selected one of said generally flat intermediate projecting portion surface proximal said convex projecting portion surface and said rear blade cover flat upper surface, and a recess in the other of said generally flat projecting portion intermediate surface and said rear blade cover flat upper surface, said protuberance and said recess being configured and placed for said recess to snugly receive said protuberance when said blade cover is fully installed in said seat belt receptacle to resist the inadvertent removal of said blade cover from said seat belt receptacle.

5. An auto emergency tool according to claim 1, wherein said tire air pressure gauge assembly further comprises:

a digital readout for displaying the tire pressure of a tire, said digital readout display being convertible between a psi reading and a bar reading; and a pressure reading actuator to switch said digital readout display between said psi reading and said bar reading.

6. An auto emergency tool according to claim 5, wherein said digital readout display is located on said rear upper portion of said main portion of said ergonomic housing.

7. An auto emergency tool according to claim 1, and further comprising:

a sonic alarm assembly comprising:

an electrical circuit including a piezo electric speaker for making an alarm sound; and a sonic alarm actuator button actuable for closing said electrical circuit with a battery power source to actuate said piezoelectric speaker, said electronic circuit including an alarm termination mode to deactuate said sonic alarm actuator, and an electronic delay device for delaying said electronic circuit from entering said alarm termination mode for a predetermined amount of time following the actuation of said actuator button.

8. An auto emergency tool according to claim 7, wherein said illuminating assembly actuator button and said sonic alarm actuator button are located in opposite ends of said lower portion of said main housing portion.

9. An auto emergency tool apparatus comprising an auto emergency tool and a visor clip for releasably securing said auto emergency tool to the visor of a motor vehicle, said auto emergency tool comprising:

an ergonomic housing having an upper portion, a lower portion, a forward end portion and a rearward portion, said housing comprising:

a main housing portion comprising:

a housing front portion and a housing back portion; said housing front portion and said housing back portion having corresponding shapes to fit together to form said main housing portion;

a forward end having a generally flat exterior and having a glass-breaker assembly opening;

a rearward end having a generally flat exterior and an LED lens opening;

a bottom surface having a centrally-disposed concave portion, an inclined forwardly-disposed surface interconnecting said concave portion and said forward end, and an inclined rearwardly-disposed portion interconnecting said concave portion and said rearward end; and a main housing top surface being generally flat and having a forwardly disposed main top portion and a projecting portion juncture at said forwardly-disposed main top portion; and said main housing portion having a relatively large thickness at said upper portion and a relatively thin thickness at said lower portion, said upper portion having a generally flat exterior, and said lower portion having a generally flat exterior, said main housing portion further comprising an inclined concave shoulder forming a transition between said upper portion and said lower portion;

a projecting portion integrally connected to said main housing portion and extending rearwardly from said projecting portion juncture, said projecting portion having a projecting portion interior surface facing said top surface of said main housing portion, said projecting portion interior surface comprising:

a concave forward projecting portion surface;

a convex rearward projecting portion surface forming a free end of said projecting portion; and a generally flat intermediate projecting portion surface interconnecting said concave forward projecting portion surface and said convex rearward projecting portion surface;

said projecting portion interior surface cooperating with said top surface of said main housing portion to define a seat belt receptacle;

an inclined seat belt cutter blade extending across said seat belt receptacle from said projecting portion and said projecting portion juncture rearwardly to said top main housing surface;

a glass-breaker assembly disposed in said glass-breaker assembly opening of said main housing portion, said glass-breaker assembly including an external guide piece and a spring-loaded pin-and-guide assembly operably connected to said guide piece for being driven outwardly from said main housing portion in response to the depression of said guide piece into said main housing portion to break glass in the path of said pin-and-guide assembly;

an illuminating assembly comprising an LED lens in said LED lens opening, at least one LED bulb, and an illuminating assembly actuator button located in said lower portion of said main housing portion for connecting said at least one LED bulb to a battery power source;

a tire air pressure gauge assembly comprising a tire air pressure nozzle, wherein said rearwardly disposed inclined portion of said bottom surface has a tire gauge nozzle opening for providing access to said tire pressure gauge nozzle; and said visor clip comprising:

an attachment hook for being clipped to a visor;

a visor clip blade cover attached to said attachment hook, said visor clip blade cover being configured and dimensioned for receiving said seat belt receptacle as said ergonomic housing is moved toward said visor clip blade cover, said visor clip blade cover comprising:

a blade cover forked end with a pair of blade cover opposing surfaces defining a slit for receiving said seat belt cutter blade when said ergonomic housing has moved towards said visor clip blade cover with said belt cutting receptacle being fully inserted on said visor clip blade cover; and a flange connecting said hook to said visor clip blade cutter, said flange having a wall for engaging said ergonomic housing and guiding said ergonomic housing and said seat belt receptacle for receiving accurately said visor clip blade cover.

* * * * *